US010161712B2

(12) United States Patent
Jones

(10) Patent No.: US 10,161,712 B2
(45) **Date of Patent: *Dec. 25, 2018**

(54) RIFLE STOCK ASSEMBLY FOR DIFFERENT BARRELED RECEIVERS

(71) Applicant: J. ALLEN ENTERPRISES, INC., Yorba Linda, CA (US)

(72) Inventor: Jeffrey Allen Jones, Yorba Linda, CA (US)

(73) Assignee: J. ALLEN ENTERPRISES, INC., Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/488,880

(22) Filed: Apr. 17, 2017

(65) Prior Publication Data

US 2017/0219310 A1 Aug. 3, 2017

Related U.S. Application Data

(63) Continuation of application No. 13/347,411, filed on Jan. 10, 2012, now Pat. No. 9,631,885.

(Continued)

(51) Int. Cl.
*F41C 23/16* (2006.01)
*F41A 11/02* (2006.01)

(Continued)

(52) U.S. Cl.
CPC ..... *F41C 23/16* (2013.01); *F41A 3/66* (2013.01); *F41A 9/24* (2013.01); *F41A 11/02* (2013.01);

(Continued)

(58) Field of Classification Search
CPC .... F41A 3/66; F41A 9/24; F41A 11/02; F41A 17/38; F41A 19/11; F41A 21/48; F41C 23/16; F41C 23/20

(Continued)

(56) References Cited

U.S. PATENT DOCUMENTS 1,071,023 A * 8/1913 Borchardt ..... F41A 17/38 89/138
2,363,772 A 11/1944 Browning (Continued)

OTHER PUBLICATIONS http://riflestocks.tripod.com/bedding.html, retrieved from the Internet on Dec. 20, 2004, Bedding the Stock: Glass Bedding, Pillar Bedding, Test Targets, pp. 1-16.

(Continued)

*Primary Examiner* — Stephen Johnson
*Assistant Examiner* — Benjamin S Gomberg
(74) *Attorney, Agent, or Firm* — Greenberg Traurig, LLP

(57) ABSTRACT

A rifle stock assembly adapted to receive and support a bolt action rifle barreled receiver is disclosed. The assembly includes a rifle stock/chassis having an elongated recess and a cage removably fastened to the chassis in the recess to receive a bolt action rifle receiver therein. The assembly may also have a pair of magazine collets fastened to the bottom of the forward portion of the chassis defining a magazine well beneath the cage. Cages having different internal surface shapes may be utilized to accommodate different barreled receivers in the same rifle stock/chassis. Different magazine collets may also be utilized to accommodate different caliber magazines used with the different barreled receivers.

18 Claims, 12 Drawing Sheets

Related U.S. Application Data

(60) Provisional application No. 61/432,424, filed on Jan. 13, 2011.

(51) Int. Cl.

| | |
|---|---|
| ***F41A 21/48*** | (2006.01) |
| ***F41C 23/20*** | (2006.01) |
| ***F41A 3/66*** | (2006.01) |
| ***F41A 9/24*** | (2006.01) |
| ***F41A 19/11*** | (2006.01) |

(52) U.S. Cl.
CPC ..... *F41A 19/11* (2013.01); *F41A 21/48* (2013.01); *F41C 23/20* (2013.01)

(58) Field of Classification Search
USPC ..... 42/49.02, 75.03
See application file for complete search history.

(56) References Cited

U.S. PATENT DOCUMENTS

| | | | | |
|---|---|---|---|---|
| 2,875,544 | A * | 3/1959 | Krieger | F41A 9/59 42/18 |
| 3,206,885 | A | 9/1965 | Dye | |
| 3,830,003 | A | 8/1974 | Clerke | |
| 4,199,886 | A | 4/1980 | Deuring | |
| 4,312,146 | A * | 1/1982 | Koon, Jr. | F41C 23/00 42/75.03 |
| 4,385,464 | A * | 5/1983 | Casull | F41C 23/00 42/75.03 |
| 4,593,488 | A | 6/1986 | Ruger | |
| 4,663,876 | A | 5/1987 | Reaume | |
| 4,674,216 | A | 6/1987 | Ruger et al. | |
| 4,679,487 | A | 7/1987 | Houseman | |
| 4,691,462 | A | 9/1987 | Mattarelli | |
| 5,423,145 | A | 6/1995 | Nasset | |
| 5,519,954 | A | 5/1996 | Garrett | |
| 6,070,352 | A * | 6/2000 | Daigle | F41A 11/02 42/49.02 |
| 6,070,354 | A | 6/2000 | Burigana et al. | |
| 6,301,817 | B1 | 10/2001 | Hogue et al. | |
| 6,457,273 | B2 | 10/2002 | Beretta | |
| 6,487,805 | B1 | 12/2002 | Reynolds | |
| 6,539,659 | B2 | 4/2003 | Salva | |
| 6,637,142 | B1 * | 10/2003 | Reynolds | F41A 21/485 42/1.06 |
| 6,701,661 | B2 | 3/2004 | Murello | |
| 6,820,533 | B2 | 11/2004 | Schuerman | |
| 7,162,823 | B2 | 1/2007 | Schoppman et al. | |
| 7,726,060 | B1 * | 6/2010 | Jones | F41A 3/66 42/75.02 |
| 7,802,392 | B2 | 9/2010 | Peterson et al. | |
| D626,618 | S | 11/2010 | Peterson et al. | |
| D629,062 | S | 12/2010 | Peterson et al. | |
| D630,698 | S | 1/2011 | Peterson et al. | |
| D634,388 | S | 3/2011 | Peterson et al. | |
| 7,912,680 | B2 | 3/2011 | Shirakawa | |
| D645,533 | S | 9/2011 | Peterson et al. | |
| 8,151,503 | B2 * | 4/2012 | Oz | F41A 17/38 42/49.01 |
| 8,264,286 | B2 | 9/2012 | Hirai | |
| D676,095 | S | 2/2013 | Peterson et al. | |
| 8,397,417 | B2 * | 3/2013 | Jamison | F41A 21/485 42/75.03 |
| 8,411,940 | B2 | 4/2013 | Dauw et al. | |
| 8,489,370 | B2 | 7/2013 | Redon et al. | |
| 9,631,885 | B2 * | 4/2017 | Jones | F41A 11/02 |
| 9,766,029 | B2 * | 9/2017 | Dextraze | F41A 11/02 |
| 2004/0211104 | A1 | 10/2004 | Eberle | |
| 2009/0288324 | A1 | 11/2009 | Peterson et al. | |
| 2013/0014418 | A1 * | 1/2013 | Dextraze | F41A 11/02 42/16 |
| 2017/0299298 | A1 * | 10/2017 | Glaros | F41C 7/00 |

OTHER PUBLICATIONS http://www.accurateinnovations.com/golden_accuracy_stocks.html, retrieved from the Internet on Mar. 22, 2005, Accurate Innovations: Innovative Advantages: Pride of Possession, The Golden Accuracy™ series riflestocks, pp. 1-2.

http://www.accurateinnovations.com/stock_installation.html, retrieved from the Internet on Mar. 22, 2005, Accurate Innovations: Take Stock in this: Golden Accuracy stocks are "Completely finished, Drop in Ready".

http://www.agsfoundation.com/safety/qloss_all.html, retrieved from the Internet on Jan. 6, 2005, Americans for Gun Safety Foundation: Firearms Glossary, pp. 1-23.

http://www.bellandcarlson.com/Page3.html, retrieved from the Internet on Dec. 20, 2004, Bell and Carlson: Stock Specifications, pp. 1-2.

http://www.brownells.com/aspx/NS/store/ProductDetail.aspx?p=9899&title=REMINGTON+700+PILLAR+BEDDING+BLOCKS, retrieved from the Internet on Dec. 20, 2004, Brownells: Remington 700 Pillar Bedding Blocks, pp. 1-2.

Weishuhn, L., http://www.galleryofguns.com/shootingtimes/Articles/DisplayArticles.asp?ID=11, retrieved from the Internet on Dec. 20, 2004, Davidson's Gallery of Guns.com Gun Review: Ruger 77/50 Muzzleloader: 7mm Remington Magnum: Is It the Ideal All-Around Hunting Cartridge?, pp. 1-4.

Simpson, L., http://www.galleryofguns.com/shootingtimes/Articles/DisplayArticles.asp?ID=781, retrieved from the Internet on Dec. 20, 2004, by Layne Simpson, Davidson's Gallery of Guns.com Gun Review: Remington's First All-New Bolt Action Rifle in 33 Years: The Model 710, Jun. 22, 2001, pp. 1-7.

http://www.getgrip.com/main/overview/overmolded.html, retrieved from the Internet on Dec. 20, 2004, Hogue, Inc. Product Overview: Rifle Stocks, pp. 1-5.

http://www.lonewolfriflestocks.com/stock_bedding_service.html, retrieved from the Internet on Dec. 27, 2004, Lone Wolf Riflestocks—Custom Rifles: Stock Bedding Service, p. 1.

http://www.mcmfamily.com/mfsinc_n/faq.html, retrieved from the Internet on Dec. 20, 2004, McMillan Fiberglass Stocks: Frequently Asked Questions, pp. 1-6.

http://www.mcmfamily.com/mfsinc_n/tactical.html, retrieved from the Internet on Dec. 20, 2004, McMillan Fiberglass Stocks: Tactical Stocks: When Precision Shooting is Not Just Your Passion, But Your Job Description, pp. 1-5.

Lermayer, R., http://www.remington.com/magazine/current/2004_0305.asp, retrieved from the Internet on Dec. 20, 2004, Remington: The Return of the Remington Bolt-Action Rimfire! The Remington rimfire that you grew up with is back in a totally new design and better than ever before, pp. 1-4.

http://www.rifle-accuracy.com, retrieved from the Internet on Dec. 27, 2004, Rifle Stocks: Get Pinpoint Accuracy With the SmartStock™, pp. 1-5.

http://www.varminthunters.com/tech/bedding.html, retrieved from the Internet on Dec. 20, 2004, Proper Action Bedding for the Precision High Power Rifle: Bedding Methods, Materials, Action Bedding, pp. 1-4.

http://www.weatherby.com/rifles/mag_ultralightweight.shtml, retrieved from the Internet on Dec. 20, 2004, Weatherby: Mark V Rifles for Magnum Catridges: Ultra Lightweight, pp. 1-2.

http://www.snipershide.com/forum/ubbthreads.php?ubb=showflat&Number=2833395&page=1, retrieved from the Internet on Dec. 15, 2011, W-3 Chassis: Rem 700 *Updated with Folder info*—Sniper's Hide Forums, pp. 1-17.

http://www.accurateinnovations.com/remington/remington-700-rifle-stock.html, retrieved from the Internet on May 11, 2012, Remington 700 stock custom made, Remington Model 700 Stock, pp. 1-2.

http://www.accuracyinternational.com/aics_kits.php, retrieved from the Internet on May 11, 2012, Sniper Rifle Systems—AE, AW, AX, AX50 & AICS Sniper Rifles | Accuracy International, pp. 1-2.

http://badgerordnance.com/triggerguards/, retrieved from the Internet on May 11, 2012, Triggerguards | Badger Ordnance, pp. 1-4.

(56) References Cited

OTHER PUBLICATIONS http://www.eberlestock.com/2011%20Sniper%20System.htm, retrieved from the Internet on May 11, 2012, Eberlestock Advanced Rifle Chassis, p. 1.
http://www.ketmer.com/hsp/stocks/index.htm, retrieved from the Internet on May 11, 2012, H-S Precision—Pro-Series Stocks, pp. 1-2.
https://www.hsprecision.com/shop2/stocks/pst.html, retrieved from the Internet on May 11, 2012, H-S Precision HS Precision—Pro-Series Tactical H-S Precision, pp. 1-2.
http://www.kineticresearchgroup.com/products/w3c.php, retrieved from the Internet on May 11, 2012, The Whiskey-3 Chassis (W3C) Overview, pp. 1-11.
http://mannersstocks.com/, retrieved from the Internet on May 11, 2012, Manners Composite Stocks, pp. 1-4.
http://www.stockysstocks.com/servlet/the-588/Manners-T4-Badger-Aluminum/Detail, retrieved from the Internet on May 11, 2012, Manners Remington 700 MCS T4A DBM (Adjustable / Vertical Grip / Hook / Beavertail) ADL BDL CDL SPS VTR XCR XHR with Badger Aluminum Bedded Detachable Magazine Chassis, pp. 1-2.
http://mcreesprecision.net/sp_pr_t.htm, retrieved from the Internet on May 11, 2012, The "MP-MODSS" "A Multi Mission Rifle Chassis", pp. 1-5.
http://www.jprifles.com/1.2.6.1_AMCS.php, retrieved from the Internet on May 11, 2012, JP Advanced Modular Chassis System™, pp. 1-3.
http://www.sinclairintl.com/.aspx/pid=43779/Product/MDT-Remington-700-TAC21-Chassis, retrieved from the Internet on May 11, 2012, MDT Remington 700 TAC21 Chassis, p. 1.
http://bulletin.accurateshooter.com/2010/01/new-eliseo-modular-remington-chassis/, Jan. 18, 2010, retrieved from the Internet on May 11, 2012, New Eliseo Modular Tactical Chassis with Twin Lowers, pp. 1-4.
http://www.ashburyprecisionordnance.com/the-saber-forsst-modular-rifle-chassis-system/, retrieved from the Internet on May 11, 2012, Folding Rifle Stock System Tactical SABER-FORSST® Modular Rifle Chassis System, pp. 1-3.
http://whiddengunworks.net/beddingblock.html, retrieved from the Internet on May 11, 2012, The V-Block A Better Bedding Block, pp. 1-3.
http://www.xlrindustries.com/chassis-options.html, retrieved from the Internet on May 11, 2012, Folding Stock Adapter, pp. 1-6.
http://www.mcmfamily.com/mcmillan-stocks-tactical-stock-list.php, retrieved from the Internet on May 11, 2012, McMillan Tactical Stocks, McMillan Fiberglass Stocks, Synthetic Stocks, Tactical Stocks, pp. 1-11.
http://tacmodstock.com/Concept/index.php, retrieved from the Internet on Aug. 8, 2013, TACMOD Sniper Chassis System, pp. 1-2.

* cited by examiner

RIFLE STOCK ASSEMBLY FOR DIFFERENT BARRELED RECEIVERS

RELATED APPLICATIONS

This application is a continuation of U.S. patent application Ser. No. 13/347,411 filed Jan. 10, 2012, entitled Rifle Stock Assembly For Different Barreled Receivers, which claims the benefit of priority of U.S. Provisional Patent Application Ser. No. 61/432,424, entitled Augmentable Firearm Fastening Assembly and Method of Use, filed Jan. 13, 2011, the contents of each of which is incorporated herein by reference in its entirety.

BACKGROUND

1. Field

The present disclosure generally relates to firearms and more particularly to a single rifle stock assembly system for accommodating a variety of barreled receivers.

2. Related Art

Since the beginning of the introduction and use of firearms in human history, various designs and means for assembling various components of firearms have been investigated and utilized. A conventional rifle generally comprises groups of components, each one typically consisting of several additional subcomponents. These groups include the receiver, a barrel attached thereto and the stock. The stock provides a shooter a convenient element by which the firearm is typically carried and utilized, as known in the art.

Various methods have been utilized to bed or fit receivers and the attached barrels into a stock. A rifle stock, sometimes called a chassis, typically has a rear shoulder support portion designed to be held against a shooter's shoulder, and a forward forearm support portion, that includes an appropriate recess or recesses, shaped and formed to receive, support and carry the receiver and barrel fitted thereto.

In some more modern and specialized firearms, such as bench rest and target/competition rifles, the barrels are free-floating, that is, the stock is shaped so that the barrel itself does not physically come into direct contact with the stock. Such contact can generate harmonic distortions of the barrel support system during firing that can adversely affect bullet trajectory and hence target accuracy.

Hence, stability and maintenance of a "perfect fit" is especially important to those marksmen and shooters that pursue an exacting and tight fit between the receiver, often called the "action", and the rifle stock. Such shooters can employ a well known method, which utilizes fiberglass compositions, to glass bed their actions to the stock to achieve that "perfect fit". However, such stocks are forever married to one particular receiver, and consequently only one cartridge and magazine configuration. If a shooter desires to utilize a different barreled receiver, such as one for a different caliber cartridge or a barreled receiver from a different manufacturer, an entirely different stock must be fitted to that receiver.

With today's customized rifle stocks, there are many adjustments that can be made to such stocks to accommodate a particular shooter's physical needs and desires. Such accommodations are very expensive to obtain if one must have a different stock custom made for each barreled receiver. Hence, there is a need for a rifle stock assembly that can be utilized with and can accommodate different barreled receiver configurations and magazine configurations without sacrificing the customized stock adjustment features desired and prized by a discriminating shooter.

SUMMARY

An exemplary embodiment of a rifle stock assembly in accordance with the present disclosure adapted to receive and support a barreled receiver includes a rifle stock/chassis, a cage secured within the stock/chassis, and a pair of magazine collets fastened to a bottom of the stock/chassis that define a magazine well. The stock/chassis can be used with different barreled receivers. The cage and magazine collet pair are specifically configured for a barreled receiver having particular dimensions. Thus if several barreled receivers by the same or different manufacturers have the same receiver dimensions, the same cage and magazine collet pair may be utilized with each barreled receiver.

The stock/chassis (hereafter "chassis") has a rear portion and an elongated forward portion. The rear portion typically provides for the shooter a shoulder support, a cheek support, and a hand grip. The forward portion and rear portion of the chassis may be integrally formed, separate portions that are bolted or otherwise fastened together, or hinged to provide a folding stock/chassis configuration. The forward portion of the chassis has a bottom and an upper surface and an elongated recess through the upper surface forming channel to receive the barreled receiver therein. The cage is removably received in the recess and fastened to the chassis. The cage is a frame structure that has vertical openings therethrough shaped to mate a particular barreled receiver with the chassis. A pair of magazine collets is fastened to the bottom of the forward portion of the chassis. The spacing between these collets defines the magazine well beneath the cage to complete the stock/chassis assembly. Different shaped magazine collets and cages with different internal dimensions may be installed in the stock/chassis to complete an assembly that can facilitate installation of different barreled receivers.

The forward portion of the chassis has a plurality of alternating vertical and horizontal surfaces within the recess forming a series of ledges. The outer surface of the cage has a shape matching, i.e. complementary to, the vertical and horizontal surfaces of the chassis within the recess so that the cage and chassis, when together, are interlocked in place. Both the chassis and the cage have longitudinally spaced front and rear vertical openings therethrough. The rear vertical opening through the chassis is for receipt of the receiver trigger assembly. The front vertical opening forms part of a magazine well. A trigger guard and magazine release assembly is preferably bolted in front of and behind the trigger assembly to the bottom of the stock/chassis.

The magazine collet pair are fastened to the bottom of the stock/chassis in front of and behind the front vertical opening so as to define the magazine cavity. As the magazine cavity is immediately in front of the trigger guard, a paddle magazine release may be attached to the trigger guard to releasably hold an ammunition magazine in the cavity in registry with the receiver.

One embodiment of a rifle stock assembly adapted to receive and support a bolt action barreled receiver in accordance with the present disclosure may include a rifle stock/chassis having a rear portion and an elongated forward portion, the forward portion having a bottom and an upper surface and an elongated recess through the upper surface to receive the bolt action receiver therein. The forward portion has a first vertical opening passing through the bottom of the chassis and the elongated recess and a second vertical opening spaced rearward of the first vertical opening passing through the bottom of the chassis. A cage is removably fastened to the chassis in the recess. The cage is configured to mate the bolt action receiver with the chassis. The cage has a first vertical opening and a second vertical opening therethrough aligned with the openings through the chassis. The assembly also includes a pair of magazine collets fastened to the bottom of the forward portion of the chassis defining a magazine well beneath the first vertical openings.

Another embodiment of the rifle stock assembly in accordance with the present disclosure may utilize a two piece cage in the assembly. The cage has a rear portion and a separate front portion that may or may not be spaced longitudinally apart in the recess of the chassis. This two piece cage permits interchange of barreled receivers having the same trigger assembly but chambered for different length cartridges, and hence different size magazines. Various additional objects, features and advantages of the present invention can be more fully appreciated with reference to the detailed description and accompanying drawings that follow.

DETAILED DESCRIPTION

Descriptions of exemplary embodiments are provided and reference made to the accompanying figures which form the part thereof, and which are shown by way of illustration of exemplary implementation of teachings provided herein. It is to be understood that other embodiments and application of the teachings provided herein may be utilized and structural and functional changes may be made without departing from the spirit and scope of the present disclosure. Additionally, the figures are for illustrative purposes and no relative or limiting sizes or ratios are intended.

Figure 1:
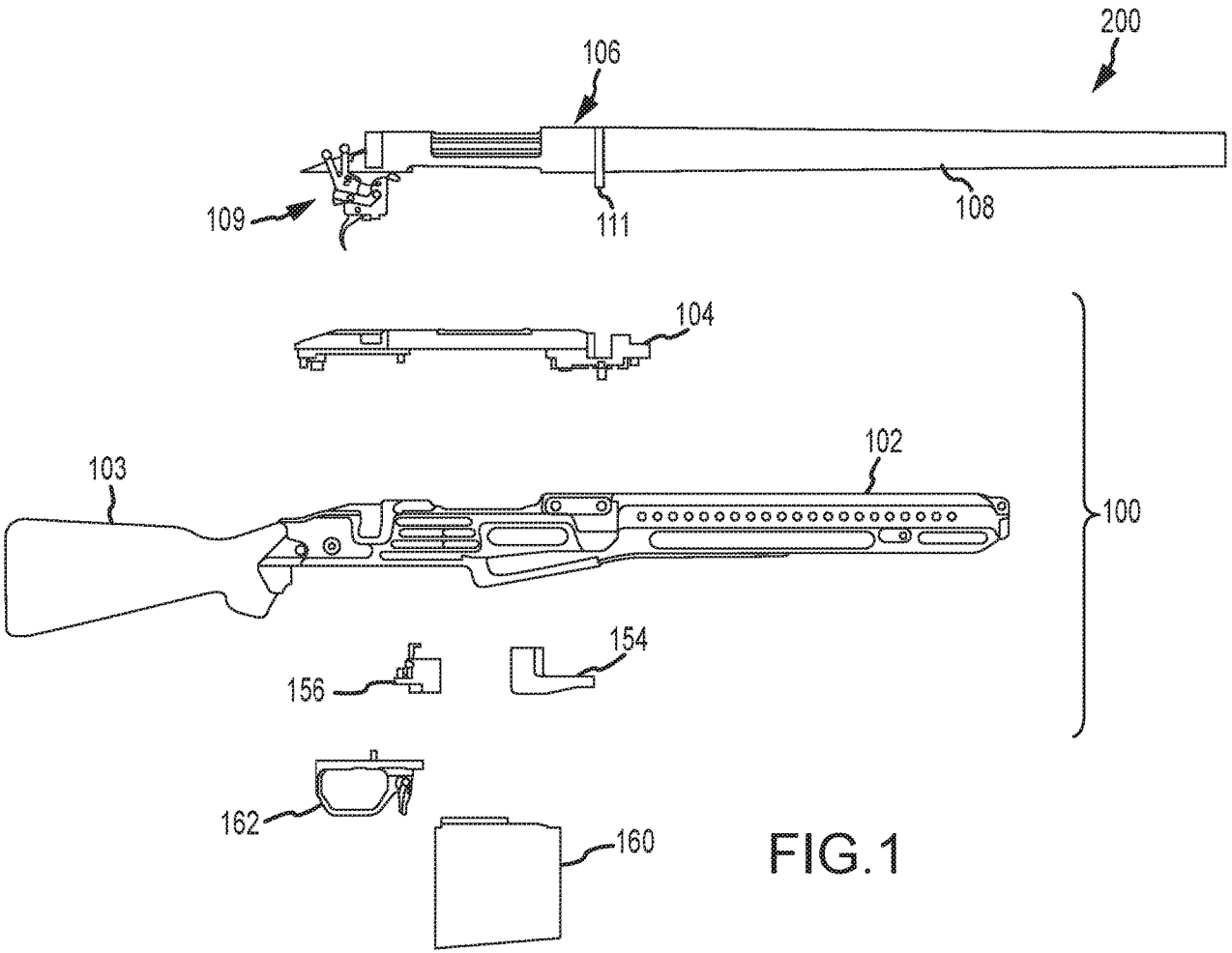
FIG. 1 is an exploded view of a bolt action rifle barreled receiver separated from a stock/chassis assembly in accordance with one embodiment of the present disclosure.

An exploded view, of a bolt action rifle barreled receiver 106, 108 is shown separated from a stock/chassis assembly 100 in accordance with one embodiment of the present disclosure in FIG. 1. The receiver 106 includes a trigger assembly 109 and a recoil lug 111 extending down beneath the body of the receiver 106. The receiver 106 and barrel 108 are threaded together as a single structural unit in a conventional manner, well known to those skilled in the art.

The stock/chassis assembly 100 in accordance with the present disclosure is assembled as a separate unit into which the barreled receiver 106, 108 is bolted in place. The stock/chassis assembly 100 preferably includes the stock/chassis 102, a cage 104 and a pair of magazine collets 154 and 156. Also fastened to the stock/chassis assembly 100 to complete the rifle 200 is a magazine 160 and a trigger guard/magazine release assembly 162.

Figure 2:
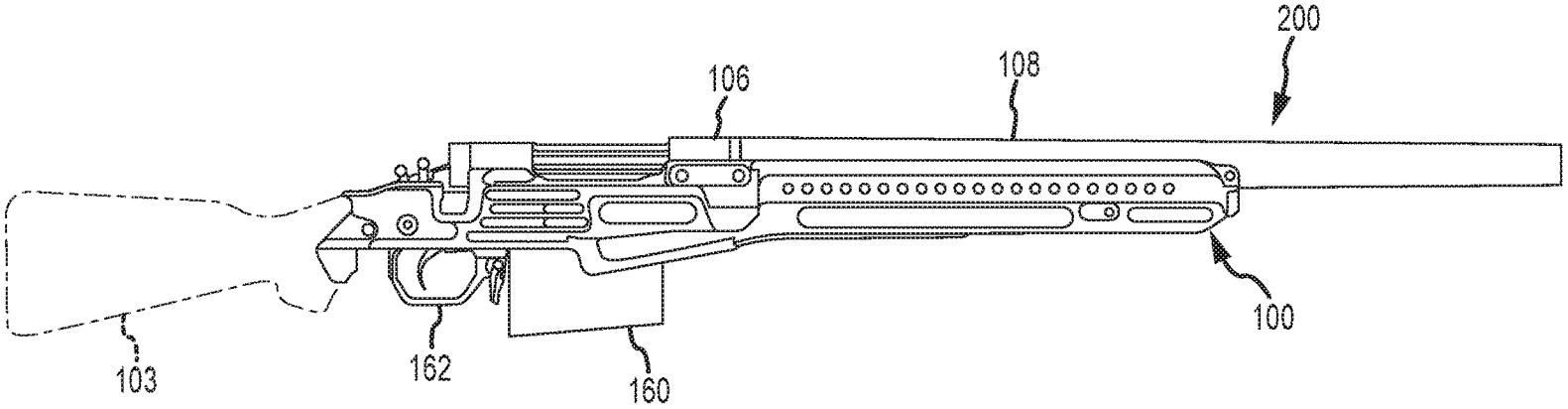
FIG. 2 is a perspective partial view of the rifle receiver installed in the stock/chassis assembly shown in FIG. 1.

FIG. 2 shows the stock/chassis assembly 100 joined with the barreled receiver 106, 108 and with the trigger guard assembly 162 and magazine 160 installed. The rear portion 103 of the stock/chassis is shown in both FIG. 1 and FIG. 2 is shown in dashed lines as it is separately bolted to the chassis 102 and may have several alternative configurations depending on the preferences of the shooter.

Figure 3:
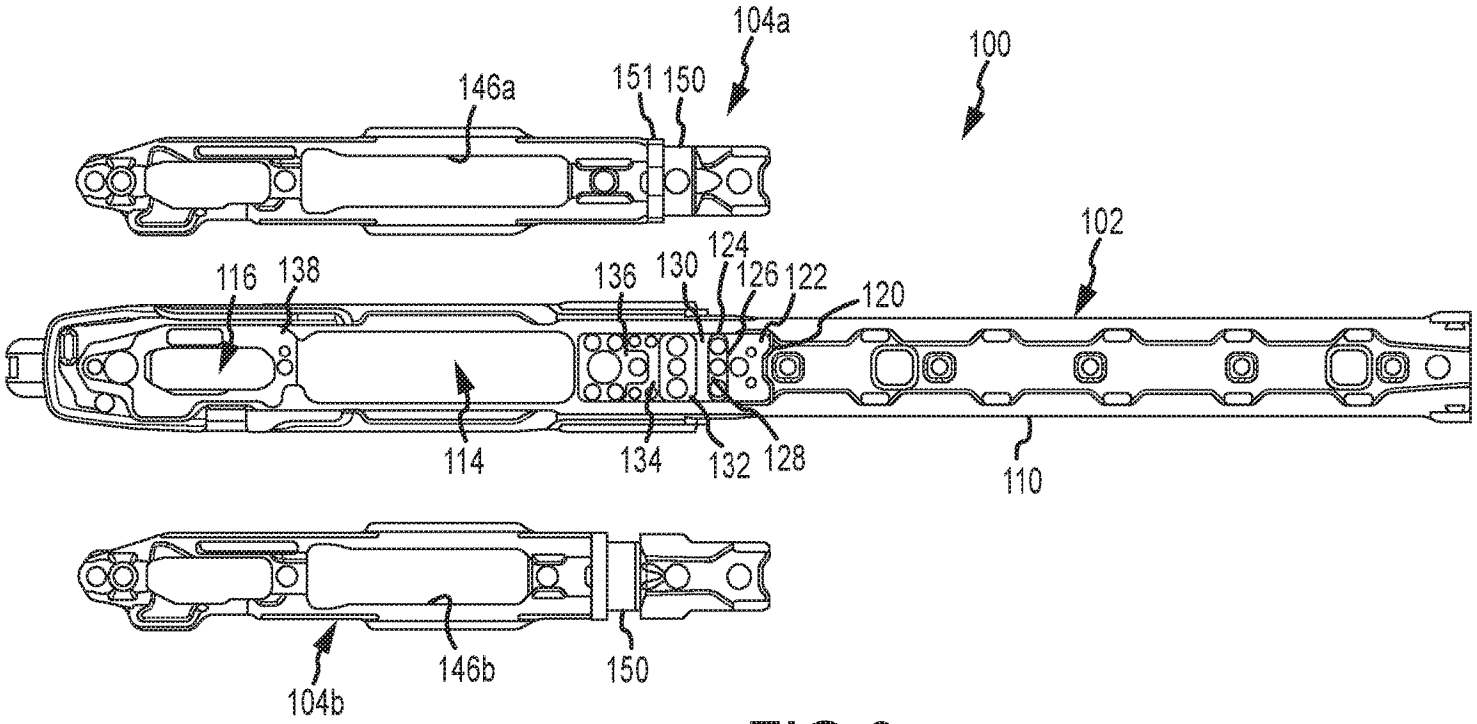
FIG. 3 is a top view of a stock/chassis between top views of two different cages in accordance with the present disclosure.
Figure 4:
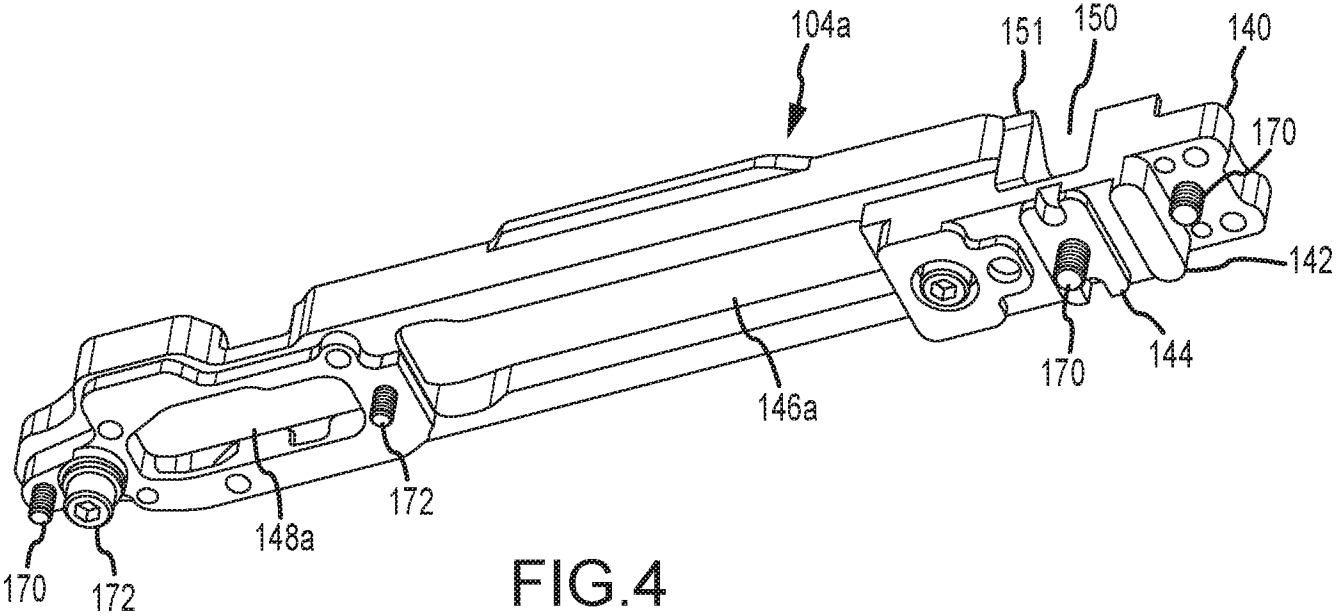
FIG. 4 is a separate perspective underside view of one cage in accordance with the present disclosure.
Figure 5:
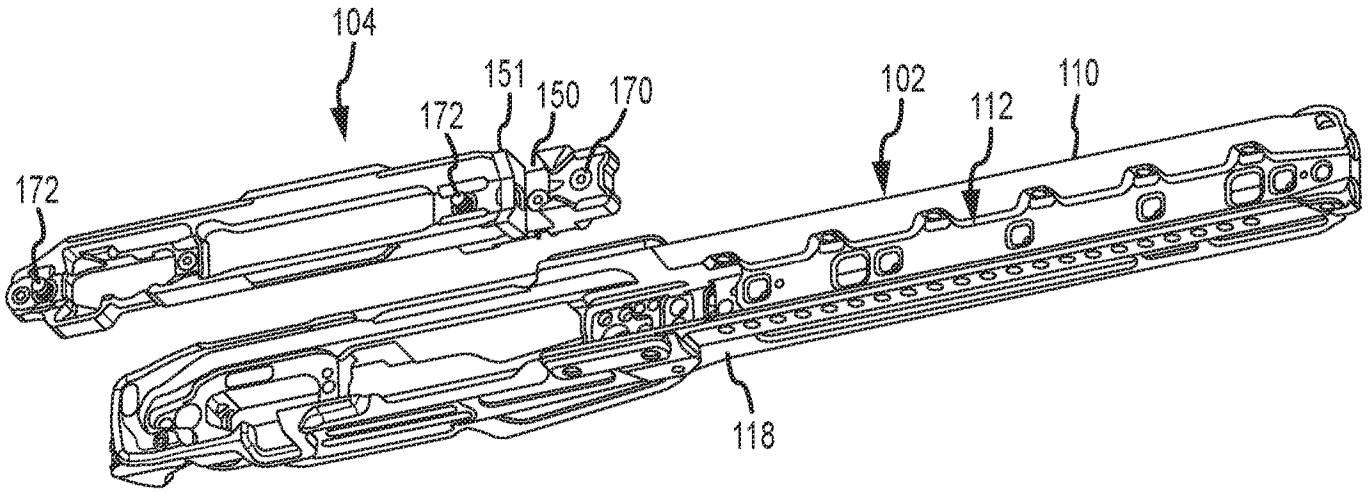
FIG. 5 is an exploded perspective upper view of a cage and a front portion of the chassis into which the cage is to be installed in accordance with the present disclosure.
Figure 6:
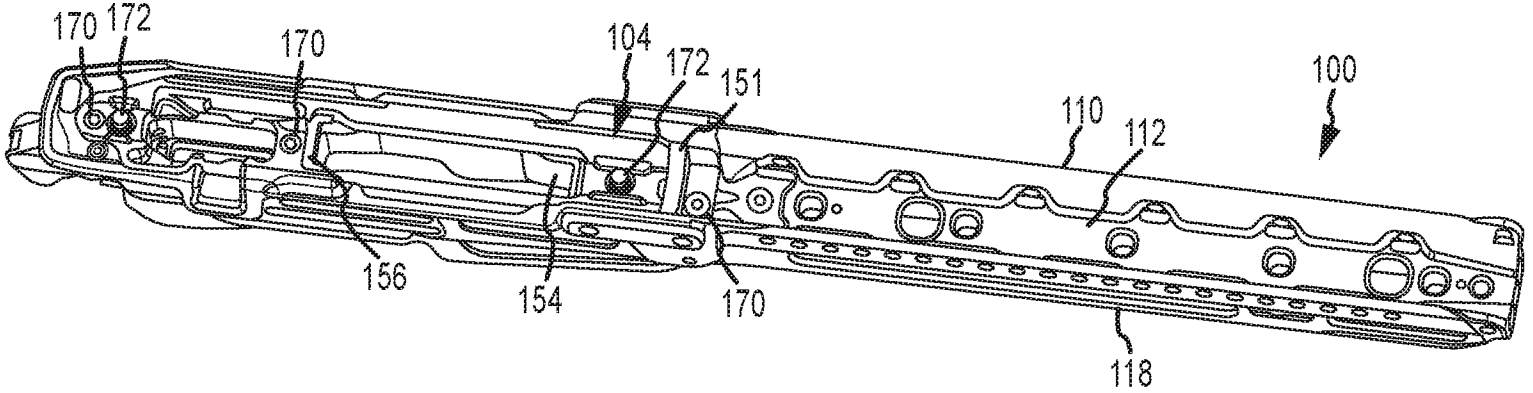
FIG. 6 is an upper perspective view of the assembled stock/chassis assembly shown in FIG. 1 without a magazine installed in the magazine well.
Figure 7:
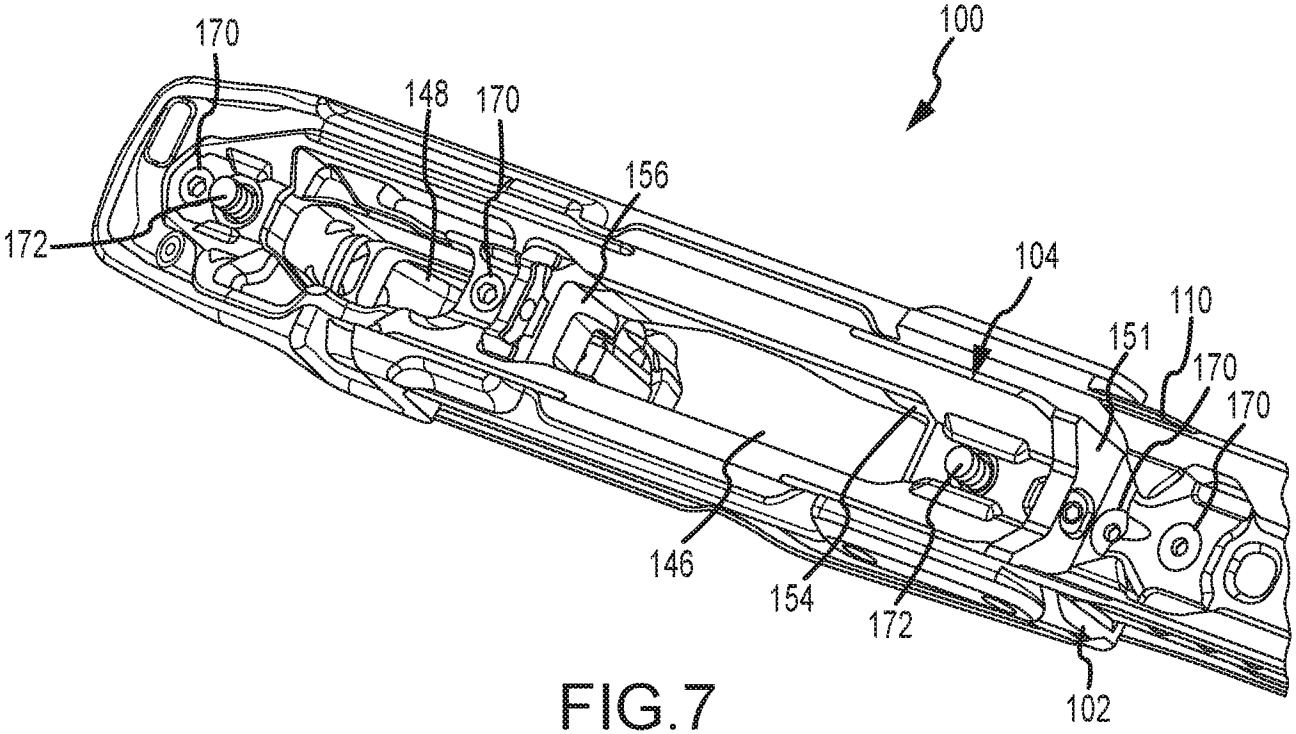
FIG. 7 is an enlarged upper perspective view of the assembled stock/chassis assembly shown in FIG. 6.

Several views of the stock/chassis 102 and cages 104*a, b* are shown in FIGS. 3-7. FIG. 4 is a separate underside perspective view of one of the cages 104*a*. FIG. 5 shows a cage 104 being inserted into a stock/chassis 102. The exterior surface of the cage 104 has a shape complementary to the internal shape of the recess 112 around the openings 114 and 116 such that together the cage and chassis in turn mate the barreled receiver 106, 108, as described in further detail below. FIG. 6 is an upper perspective view of the chassis assembly 100 with the cage 104 and collets 154, 156 fastened to the chassis 102. FIG. 7 is an enlargement of a portion of the assembly 100 shown in FIG. 6 showing the assembled components in more detail.

As is best seen in FIG. 3, the stock/chassis (hereafter chassis) 102 is a solid body preferably made of a light weight metal such as aluminum or titanium. Alternatively the chassis 102 may be made of a rigid composite fiber material such as a carbon fiber. The chassis 102 has an upper surface 110, a bottom 118, and a channel shaped recess 112 through the upper surface 110. This recess 112 forms essentially a channel which cradles the receiver 106 and a portion of the barrel 108 therein. The chassis 102 also has an elongated longitudinal first vertical passage or opening 114 therethrough and a second vertical passage or opening 116 therethrough behind the first opening 114. The first vertical passage 114 is sized to receive a cartridge magazine 160 therein beneath and in registry with the receiver 106. The second vertical passage 116 receives the trigger assembly 109 of the receiver 106.

FIG. 3 is a top or plan view of the chassis 102 with two different sized cages 104*a* and 104*b* positioned adjacent the chassis 102. Working from front to rear within the recess 112, the recess 112 in the chassis 102 has a first vertical wall 120. This vertical wall 120 joins a horizontal ledge 122 along the bottom of the recess 112 which joins a transverse flat bottomed slot 124 having vertical front and rear walls 126 and 128. Rear wall 128 rises to join a second horizontal surface 130 that is spaced from a second slot 132. A pair of lateral shelves 134 project upward from a flat surface 136 that ends at the front vertical passage 114. At the rear of the front passage 114 is a recessed surface 138 that forms a notched shelf around the rear opening 116.

The underside or bottom of the cage 104*a*, as shown in the perspective view of FIG. 4, has an overall external shape complementary to the internal contour of the recess 112 just described adjacent the passages 114 and 116. The bottom of cage 104*b* is identical in contour as cage 104*a*, since both are designed to mate into the chassis 102. Hence only 104*a* will be described. Beginning at the front end 140 of the cage 104*a*, the cage has a first projection 142 having a rectangular cross sectional shape in its longitudinal direction that fits into the and engages the slot 124 in the recess 112. A second projection 144, also having a rectangular cross sectional shape in the longitudinal direction, engages the shelves 134 and mates with surface 136. These projection features provide an interlocking structure between the cage 104 and the chassis 102 around the transverse groove 150 that receives the recoil lug 111 on the receiver 106.

The cage 104*a, b* has an internal surface contour complementary to the bottom of the particular rifle barreled receiver 106, 108 to which it is to be mated. Each different dimensioned rifle barreled receiver, which also depends on the caliber, as well as manufacturer, e.g. Winchester and Remington, will have a particular mating cage 104. Each cage 104*a, b* has an first front opening 146*a, b*, sized to accommodate a cartridge magazine 160 (FIG. 1) and a second rear opening 148*a, b*, to accommodate the trigger assembly 109 of the receiver 106, 108 to which it is to be mated. In FIG. 3, two different cages are shown. Both cages 104*a* and 104*b* have essentially the same outer and bottom exterior shape, with the primary differences being (1) the lengths and dimensions of the internal openings 146 and 148, and (2) the placement of a recoil lug reception groove 150, which are dictated by the dimensions of the particular barreled receiver to which the cage 104 is to be mated. Also visible in FIG. 4 are fasteners 170 and 172. Fasteners 170 and 172 are preferably Allen bolts, but other types of fasteners may also be used. Fasteners 170 are used to secure the cage 104 to the chassis 102. Fasteners 172, preferably captured in the cage 104, are used to secure the cage 104 to the receiver 106.

FIG. 5 shows a cage 104 spaced above and in registry with the chassis 102. In the transverse slot 150, into which the recoil lug 111, not shown, fits when the barreled receiver 106, 108 is inserted, is a hardened steel recoil plate 151. This recoil plate 151 is typically wider than the recoil lug 111 on the barreled receiver 106, and acts to distribute recoil forces both across the cage 104 and into the chassis 102 via the interlocking fit of the cage 104 within the recess 112 of the chassis 102. The stepped configuration of the cage 104 as shown in FIG. 4, and the mating surface configuration in the recess 112 in the chassis 102 ensures that recoil forces are widely and more evenly distributed to the chassis 102 and not concentrated adjacent the recoil lug 111. This recoil plate 151 is replaceable and configurable depending on the particular shape and thickness of the particular recoil lug on the receiver 106. The recoil plate 151 may be made of hardened steel, titanium, or similar material that is substantively harder than aluminum, which is the typical material from which the chassis 102 is made.

FIG. 6 is an upper perspective view of the assembled chassis assembly 100. FIG. 7 is an enlarged perspective view of the assembled stock/chassis assembly 100 showing the structures in more detail. The cage 104 is bolted in place to the chassis 102 via four bolts 170, also shown in FIG. 4. The threaded ends of the Allen bolts 172 for securing the barreled receiver 106, 108 to the assembly 100 are visible in FIG. 5. These Allen bolt fasteners 172 are accessed via bores (not shown in FIG. 6) through the bottom of the chassis 102. Fasteners 172 are preferably rotatably captured in the cage 104. The tops of the magazine collets 154 and 156 defining the magazine well can readily be seen through the cage opening 146 in this view.

Figure 8:
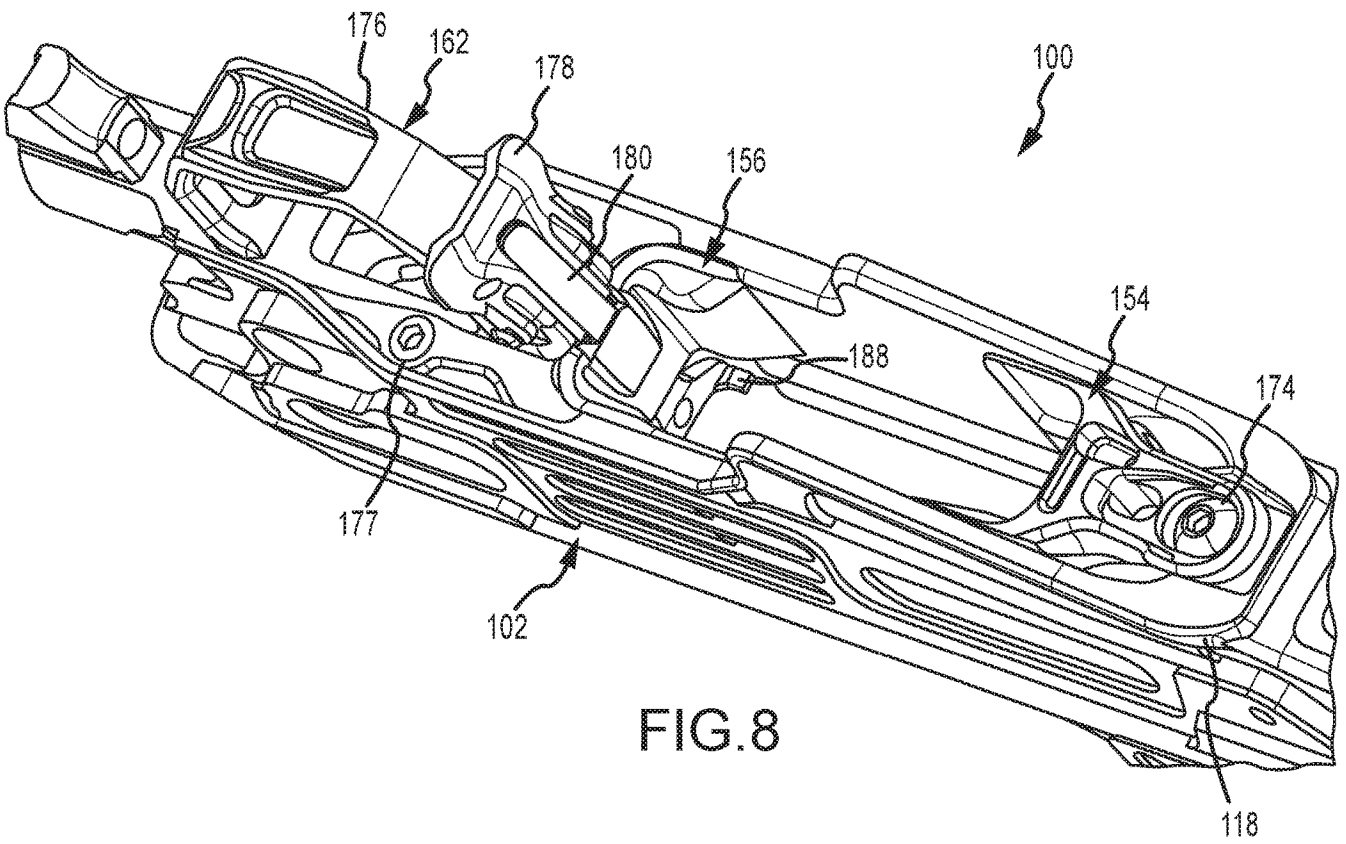
FIG. 8 is an enlarged partial bottom perspective view of the assembled stock/chassis assembly shown in FIG. 6.
Figure 9:
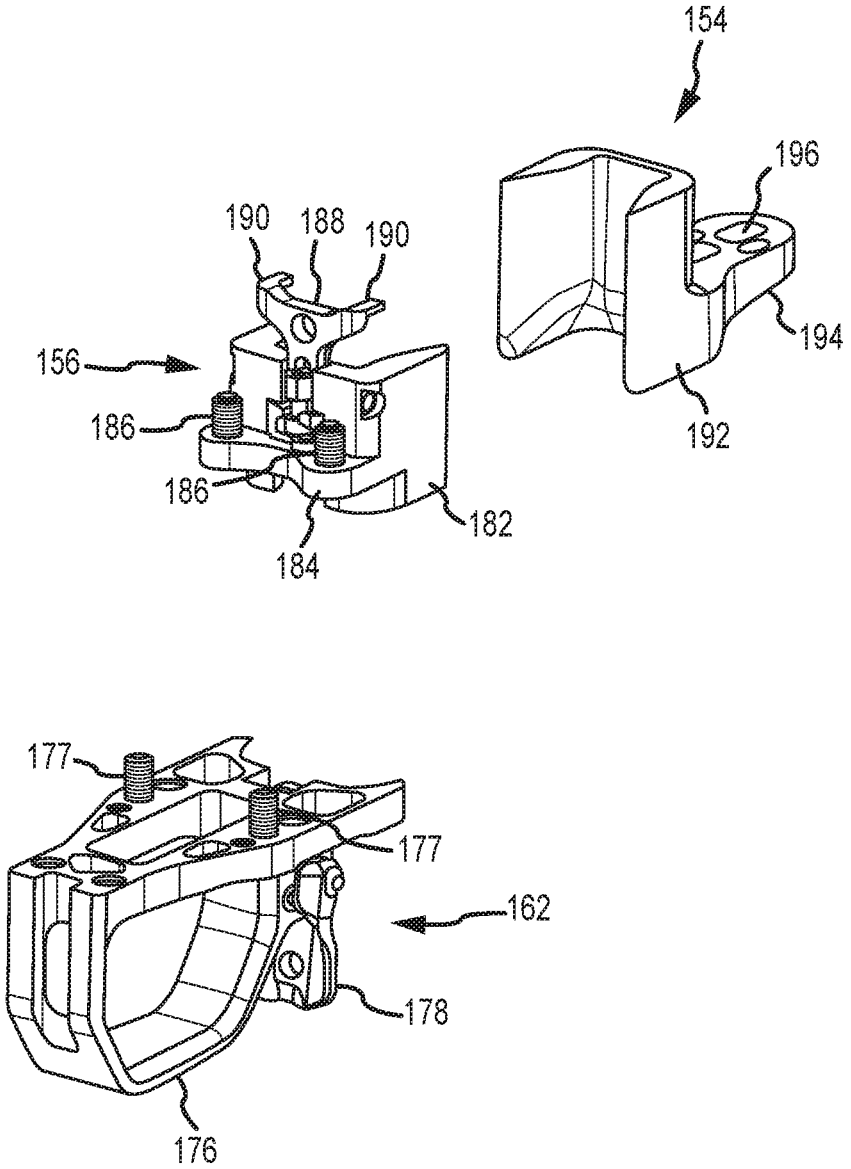
FIG. 9 is a top perspective exploded view of the collet pair and trigger guard/magazine release assembly separate from the stock/chassis in accordance with the present disclosure.
Figure 10:
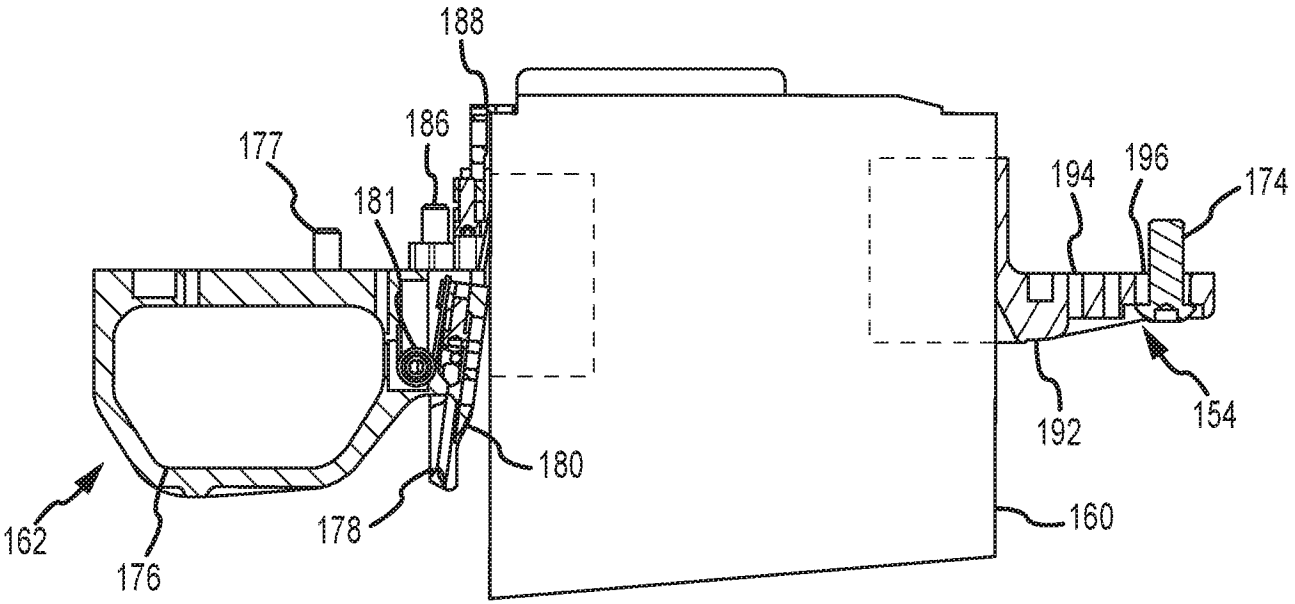
FIG. 10 is an assembled side sectional view of the collet pair and trigger guard/magazine release assembly in accordance with one embodiment of the present disclosure.

FIG. 8 is a bottom perspective view of the assembled chassis assembly 100 shown in FIG. 7. Fastened to the bottom 118 of the chassis 102 are the C shaped front magazine collet 154, the C shaped rear magazine collet assembly 156, and the trigger guard assembly 162. The front collet 154 is fastened in place via bolt 174. FIG. 9 is an exploded perspective view of the trigger guard assembly 162, the front collet 154 and the rear collet assembly 156. FIG. 10 is a longitudinal sectional view through the assembly 100 with the chassis 102 not shown for clarity, and with an exemplary magazine 160 installed between the collets 154 and 156.

The trigger guard assembly 162 includes an oval shaped trigger guard 176 fastened to the bottom 118 of the chassis 102 via fasteners 177, a paddle magazine release lever 178, and a magazine catch sear 180. The catch sear 180 is removably fastened to the lever 178. The catch sear 180 may be interchangeable depending on the particular design of the magazine 160. The paddle magazine release lever 178 is an elongated member pivotally fastened to the trigger guard 176 and its lower end is spring biased in a clockwise direction toward the trigger guard 176 as shown in FIG. 10 via spring 181 housed within the trigger guard 176 casting.

The rear magazine collet 156 is a generally C shaped guide body 182 that has a rear flange 184 fastened to the chassis 102 via bolts 186 seen in FIG. 9. The collet 156 also has an L shaped fork, called a "Mag stop" 188 that extends upward from the body 182 into the magazine well and captures the upper rear corner of an inserted magazine 160 as can be seen in FIG. 10. This mag stop 188 is adjustably supported in the collet body 182 on the threaded stem 224, as more fully explained below, so that the height of the fork "fingers" 190 can be adjusted if needed.

The front magazine collet 154 is a generally C shaped guide body 192 that has a front flange 194 that is bolted to the bottom of the chassis 102 via fastener 174 as is shown in FIG. 8. Together collets 154 and 156 form a generally rectangular sleeve through which the magazine 160 can be inserted and withdrawn from the chassis assembly 100.

Various modifications may be made to the embodiments described. For example, the cage 104 may be formed as a two piece cage, separated laterally, in which the front portion and rear portion are spaced from each other longitudinally around front opening 146. In one such a modification a different front portion can be substituted while the rear portion remains the same. In an alternative, the front portion may be configured along with the recess in the chassis 102, so that pegs or protrusions on the underside of the front portion may be inserted into corresponding sockets or blind holes in the chassis to adjust the spacing for different actions. In such configurations, long and/or short receivers, or actions, could be accommodated without having to replace the rear portion of the cage 104. Furthermore, the width of the cage 104 may be made adjustable so as to accommodate different width magazines. In such a case, of course, different magazine collets would be needed. The magazine collets 154 and 156 in such a case could be split longitudinally to provide two lateral halves, connected by threaded fasteners, so that the width could be adjusted accordingly.

Ammunition magazines are typically made of sheet metal and their tolerences are not close between manufactured lots. The collets and magazine release assemblies in accordance with the present disclosure address these variations by being adjustable in order to firmly capture specific magazines accurately beneath the rifle receiver in the chassis. In particular, the front collet 154 shown in FIGS. 9 and 10 may be adjusted forward and back in the longitudinal direction by virtue of the elongated bore 196 through which the bolt 174 passes in flange 194 to secure the collet 154 to the chassis 102. In this manner magazines that are slightly longer or shorter can be easily accommodated.

Similarly, the height between the upper rear edge of a magazine 160 that abuts the mag stop 188 and the catch ledge on the magazine that engages the sear 180 to capture the magazine may vary. Therefore the mag stop 188 and the sear 180 are uniquely made adjustable in embodiments of this disclosure so as to accommodate such variations.

Figure 11:
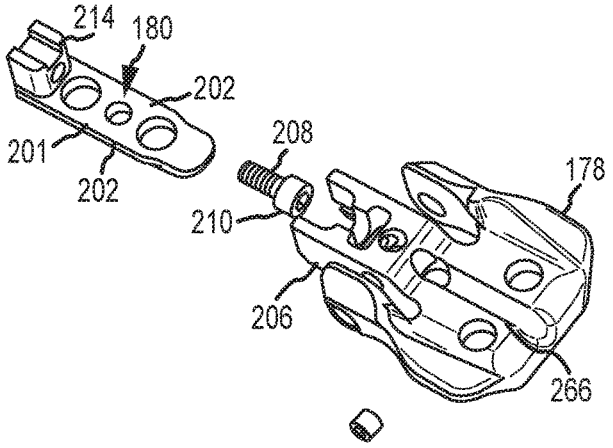
FIG. 11 is an exploded underside view of the magazine release paddle assembly in accordance with the embodiment shown in FIG. 10.
Figure 12:
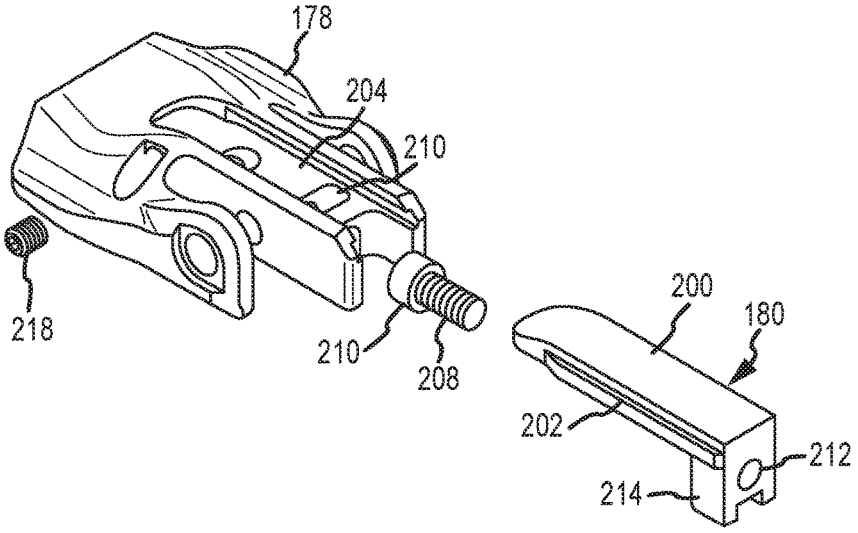
FIG. 12 is an exploded upper perspective view of the magazine release paddle assembly in accordance with the embodiment shown in FIG. 10.

The configuration of the sear 180 in the paddle 178 is best shown in FIGS. 11 and 12. The configuration of the mag stop 188 in the rear collet 156 is best shown in FIGS. 9 and 13.

Turning now to FIG. 11, an underside exploded perspective view of the paddle 178 and sear 180 is shown. A front perspective view of the paddle 178 and sear 180 is shown in FIG. 12. The sear 180 is an elongated L shaped body for which the long leg 201 has a T-shaped cross sectional shape formed by parallel edge flanges 202 that extend along the sides of the long leg 200. The paddle 178, in turn, has a complementarily T-shaped mating channel 204 formed in its front side. The long leg 201 of the sear 180 slides in this channel 204. The paddle 178 has a cross slotted channel 206 which captures a bolt 208 therein. This bolt 208 has its head captured in the cross slot 210 of the channel 206. The bolt 208 threadably engages a threaded bore 212 through the short leg 214 of the sear 180. Rotation of the bolt 208 thus adjusts the position of the sear 180 along the channel 204. A groove 216 aligned with the head 210 of the bolt 208 permits a user to turn the bolt 208 from beneath the assembly 100 with a suitable Allen wrench to adjust the position of the sear 180 within the paddle 178. A set screw 218 is then tightened against the distal end of the long leg 201 of the sear 180 to lock the sear 180 at the desired position in the paddle 178.

Figure 13:
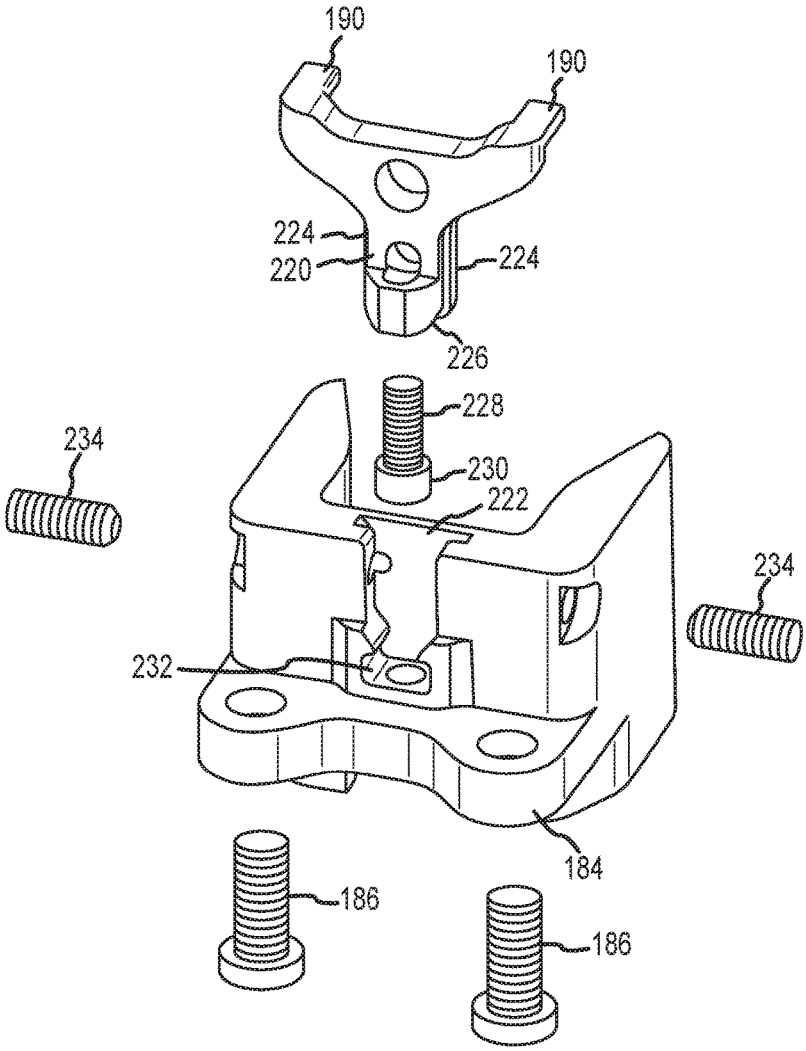
FIG. 13 is a separate exploded perspective view of the rear magazine collet shown in FIGS. 1, 9, and 10 in accordance with the present disclosure.

Turning now to FIG. 13, an exploded view of the rear collet 156 is shown. The collet 156 basically consists of two pieces: a main C, or U, shaped body 182 shaped to cup or wrap around the rear of a magazine, and a Y shaped mag stop 188 having its stem 220 captured within a vertical T-shaped slot 222 milled or otherwise formed in the collet body 182. The stem 220 has a pair of parallel flanges that extend along the length of the stem 220. These flanges 224 engage corresponding features of the T-shaped slot 222. At the lower end of the stem 220 is an integral nut 226. A threaded bolt 228 has its head 230 captured n a cross slot 232 and its threaded end engaged with the nut 226 so that, as the bolt 228 is turned, the mag stop 180 moves up and down within the slot 220.

Finally, a pair of set screws 234 in threaded bores into the T shaped slot 220 engage the stem 220 to lock the mag stop 188 in position once the proper mag stop height is determined. It is the combination of the position of the mag stop 188 in the slot 222, and the position of the sear 180 in the paddle 178, together with the front to rear placement of the front collet 154, that dictate the closeness of fit of a particular magazine 160 in the chassis 102.

It is to be understood that the examples and embodiments described herein are for illustrative purposes only and that various modifications or changes in light thereof will be suggested to persons skilled in the art and are to be included within the spirit and purview of this application and scope of the appended claims and any combinations thereof.

What is claimed is:

1. A rifle stock assembly adapted to receive and support a barreled receiver, the assembly comprising:

a rifle stock/chassis having a rear portion and an elongated forward portion, the forward portion having a bottom and an upper surface and an elongated recess through the upper surface to receive the barreled receiver therein; and a pair of magazine collets each configured to be fastened to the bottom of the forward portion of the rifle stock/chassis, each of the magazine collets having a C shaped face portion, wherein the C shaped face portions of the pair of collets face each other and define a sleeve shaped magazine well beneath the elongated recess through the upper surface of the rifle stock/chassis, and wherein each collet of the collet pair has a through bore for receiving a fastening bolt extending into the bottom toward the upper surface of the forward portion of the rifle stock/chassis and the bore through a front one of the collet pair is elongated to permit adjustment of spacing between the facing pair of collets.

2. The assembly according to claim 1 further comprising a trigger guard assembly against a rear one of the collet pair, the trigger guard assembly including an adjustable magazine catch sear fastened to a magazine release lever beneath the C shaped portion of the rear collet.

3. The assembly according to claim 1 further comprising a rear one of the collet pair including a separable fork extending upward from the C shaped portion for capturing a corner of an inserted magazine, wherein a position of the fork with respect to the C shaped portion of the rear one of the collet pair is adjustable.

4. The assembly according to claim 3 wherein the separable fork has a stem adjustably attached to the C shaped portion having a pair of parallel flanges along sides of the stem.

5. The assembly according to claim 4 wherein the C shaped portion of the rear one of the pair of collets has a vertical T-shaped slot receiving the stem of the separable fork.

6. The assembly according to claim 5 further comprising a trigger guard fastened to the bottom of the chassis rearward of the magazine collets.

7. The assembly according to claim 6 further comprising a paddle magazine release attached to the trigger guard.

8. A rifle stock assembly adapted to receive and support a bolt action receiver, the assembly comprising:

a rifle stock/chassis having a rear portion and an elongated forward portion, the forward portion having a bottom and an upper surface and an elongated recess through the upper surface to receive the bolt action receiver therein, the forward portion having a first vertical opening passing through the bottom of the chassis and the elongated recess; and a pair of magazine collets fastened to the bottom of the forward portion of the rifle stock/chassis adjacent the first vertical opening, each of the magazine collets having a C shaped face portion and a portion fastenable to the rifle stock/chassis, wherein the C shaped face portions of the pair of collets face each other and define an adjustable sleeve shaped magazine well beneath the vertical opening in the rifle stock/chassis, and wherein each collet of the collet pair has a through bore for receiving a fastening bolt extending into the bottom toward the upper surface of the forward portion of the rifle stock chassis and the bore through a front one of the collet pair is elongated to permit adjustment of spacing between the facing pair of collets.

9. The assembly according to claim 8 further comprising a trigger guard assembly against a rear one of the collet pair, the trigger guard assembly including an adjustable magazine catch sear fastened to a magazine release lever beneath the C shaped portion of the rear collet.

10. The assembly according to claim 9 wherein the sear is an elongated member having a T shaped cross section riding in a complementary T shaped slot in the magazine release lever.

11. The assembly according to claim 8 further comprising a rear one of the collet pair including a separable fork extending upward from the C shaped portion for capturing a corner of an inserted magazine, wherein a position of the fork with respect to the C shaped portion is adjustable.

12. The assembly according to claim 11 wherein the separable fork has a stem adjustably attached to the C shaped portion having a pair of parallel flanges along sides of the stem.

13. The assembly according to claim 12 further comprising a trigger guard assembly against a rear one of the collet pair, the trigger guard assembly including a magazine catch sear adjustably fastened to a magazine release lever beneath the C shaped portion of the rear collet.

14. A rifle stock assembly adapted to receive and support a receiver, the assembly comprising:

a rifle stock/chassis having a rear portion and an elongated forward portion, the forward portion having a bottom and an upper surface and an elongated recess through the upper surface to receive the bolt action receiver therein, the forward portion having a first vertical opening passing through the bottom of the rifle stock/chassis and the elongated recess and a second vertical opening spaced rearward of the first vertical opening passing through the bottom of the rifle stock/chassis; and a pair of C shaped replaceable magazine collets fastened to the bottom of the forward portion of the rifle stock/chassis defining a magazine well beneath the first vertical opening, each of the magazine collets having a C shaped vertically extending face portion and a horizontal portion fastenable to the rifle stock/chassis, wherein the C shaped face portions of the pair of collets face each other and define a sleeve shaped magazine well in the rifle stock/chassis, and wherein the horizontal portion of each collet of the collet pair has a through bore for receiving a fastening bolt extending into the bottom toward the upper surface of the forward portion of the rifle stock/chassis and the bore through a front one of the collet pair is elongated to permit forward and rearward adjustment of spacing between the facing pair of collets.

15. The assembly according to claim 14 further comprising a rear one of the collet pair including a separable fork extending upward from the C shaped portion for capturing a corner of an inserted magazine, wherein a position of the fork with respect to the C shaped portion is adjustable.

16. An adjustable magazine well assembly for use in a rifle stock/chassis having a rear portion and an elongated forward portion, the forward portion having a bottom and an upper surface and an elongated recess through the upper surface to receive a bolt action receiver therein, the forward portion having a vertical opening passing through the bottom of the chassis, the magazine well assembly comprising:

a pair of C shaped replaceable magazine collets fastenable to the bottom of the forward portion of the rifle stock/chassis defining a magazine well beneath the vertical opening, each of the magazine collets having a C shaped vertically extending face portion and a portion fastenable to the rifle stock/chassis, wherein the C shaped face portions of the pair of collets face each other when installed in the rifle stock/chassis, wherein each collet of the collet pair is fastenable to the rifle stock/chassis via a through bore for receiving a fastening bolt extending parallel to the magazine well into the bottom toward the upper surface of the forward portion of the rifle stock/chassis and the bore through a front one of the collet pair is elongated to permit forward and rearward adjustment of spacing between the facing pair of collets; and a trigger guard assembly fastenable to the rifle stock/chassis against a rear one of the collet pair, the trigger guard assembly including an adjustable magazine catch sear fastened to a magazine release lever beneath the C shaped portion of the rear collet.

17. The adjustable magazine well assembly according to claim 16 further comprising the rear one of the collet pair including a separable fork extending upward from the C shaped portion for capturing a corner of an inserted magazine, wherein a position of the fork with respect to the C shaped portion is adjustable.

18. The adjustable magazine well assembly according to claim 17 wherein the sear is an elongated member having a T shaped cross section riding in a complementary T shaped slot in the magazine release lever.

* * * * *